US011542117B2

(12) United States Patent
Siikonen et al.

(10) Patent No.: US 11,542,117 B2
(45) Date of Patent: Jan. 3, 2023

(54) MANAGING ELEVATOR CARS IN A MULTI-CAR ELEVATOR SHAFT SYSTEM

(71) Applicant: KONE CORPORATION, Helsinki (FI)

(72) Inventors: Marja-Liisa Siikonen, Helsinki (FI); Janne Sorsa, Helsinki (FI); Pentti Alasentie, Helsinki (FI)

(73) Assignee: KONE CORPORATION, Helsinki (FI)

( * ) Notice: Subject to any disclaimer, the term of this patent is extended or adjusted under 35 U.S.C. 154(b) by 1004 days.

(21) Appl. No.: 16/268,080

(22) Filed: Feb. 5, 2019

(65) Prior Publication Data

US 2019/0168991 A1 Jun. 6, 2019

Related U.S. Application Data

(63) Continuation of application No. PCT/FI2016/050633, filed on Sep. 13, 2016.

(51) Int. Cl.
*B66B 1/24* (2006.01)
*B66B 9/00* (2006.01)

(52) U.S. Cl.
CPC ..... *B66B 1/2466* (2013.01); *B66B 9/003* (2013.01); *B66B 2201/242* (2013.01); *B66B 2201/401* (2013.01)

(58) Field of Classification Search
CPC . B66B 1/2466; B66B 9/003; B66B 2201/242; B66B 2201/401
See application file for complete search history.

(56) References Cited

U.S. PATENT DOCUMENTS

| | | | | |
|---|---|---|---|---|
| 1,859,483 | A * | 5/1932 | Winslow | B66B 9/003 198/798 |
| 5,419,414 | A * | 5/1995 | Sakita | B66B 11/0095 187/249 |
| 5,625,176 | A * | 4/1997 | Davis | B66B 1/2458 187/387 |
| 5,865,274 | A * | 2/1999 | Kiji | B66B 9/003 187/383 |
| 6,237,721 | B1 * | 5/2001 | Siikonen | B66B 1/2458 187/382 |
| 7,694,781 | B2 * | 4/2010 | Sorsa | B66B 1/2458 187/382 |
| 10,526,166 | B2 * | 1/2020 | Gerstenmeyer | B66B 1/2491 |

(Continued)

FOREIGN PATENT DOCUMENTS

| | | |
|---|---|---|
| GB | 2 324 170 A | 10/1998 |
| WO | WO 2016/135089 A1 | 9/2016 |
| WO | WO 2016/135090 A1 | 9/2016 |

*Primary Examiner* — Jeffrey Donels
(74) *Attorney, Agent, or Firm* — Birch, Stewart, Kolasch & Birch, LLP

(57) ABSTRACT

According to an aspect, there is provided a method for managing elevator cars in a multi-car elevator shaft system. The method comprises determining, by an elevator control entity, the optimum number of elevator cars for a given time of a day in the multi-car elevator shaft system; and commanding, by the elevator control entity, at least one elevator car into at least one elevator car storage or back to service from the at least one elevator car storage based on the determination, wherein elevator cars in the at least one elevator car storage act as standby elevator cars for the multi-car elevator shaft system.

19 Claims, 6 Drawing Sheets

(56) References Cited

U.S. PATENT DOCUMENTS

| | | | | |
|---|---|---|---|---|
| 2006/0011420 | A1* | 1/2006 | Duenser | B66B 9/00 187/382 |
| 2012/0279807 | A1* | 11/2012 | Finschi | B66B 1/2466 187/384 |
| 2016/0210376 | A1* | 7/2016 | Suzuki | G06F 30/13 |

* cited by examiner

MANAGING ELEVATOR CARS IN A MULTI-CAR ELEVATOR SHAFT SYSTEM

CROSS REFERENCE TO RELATED APPLICATIONS

This application is a Continuation of PCT International Application No. PCT/FI2016/050633, filed on Sep. 13, 2016, which is hereby expressly incorporated by reference into the present application.

BACKGROUND

In a multi-car elevator shaft system, two or more cars may move in two elevator shafts independently, always in the same direction in one shaft, and change the shaft on the bottom and the top floor. In other words, the cars move upwards in one shaft and downwards in another shaft, and never move towards each other. A control system of the multi-car elevator shaft system assigns and dispatches elevator cars to serve landing or destination calls.

The multi-car elevator system has to be dimensioned so that it is able to handle both low and high traffic situations. Thus, a challenge of operating the multicar elevator system is how to operate it economically in all operating conditions.

SUMMARY

According to a first aspect of the invention, there is provided a method for managing elevator cars in a multi-car elevator shaft system. The method comprises determining, by an elevator control entity, the optimum number of elevator cars for a given time of a day in the multi-car elevator shaft system, and commanding, by the elevator control entity, at least one elevator car into at least one elevator car storage or back to service from the at least one elevator car storage based on the determination, wherein elevator cars in the at least one storage act as standby elevator cars for the multi-car elevator shaft system.

In one embodiment, the method further comprises determining, by the elevator control entity, the optimum number of elevator cars based on the current call allocation situation.

In one embodiment, alternatively or in addition, the method further comprises determining, by the elevator control entity, the optimum number of elevator cars based on traffic forecast data generated based on statistical call allocation data.

In one embodiment, alternatively or in addition, the method further comprises taking into account, by the elevator control entity, a transition period of an elevator car to or from the at least one elevator car storage when commanding the at least one elevator car into the at least one elevator car storage or back to service from the at least one elevator car storage.

According to a second aspect of the invention, there is provided an apparatus for managing elevator cars in a multi-car elevator shaft system. The apparatus comprises means for determining the optimum number of elevator cars for a given time of day in the multi-car elevator shaft system, and means for commanding at least one elevator car into at least one elevator car storage or back to service from the at least one elevator car storage based on the determination, wherein elevator cars in the at least one storage act as standby elevator cars for the multi-car elevator shaft system.

In one embodiment, the means for determining are configured to determine the optimum number of elevator cars based on the current call allocation situation.

In one embodiment, alternatively or in addition, the means for determining are configured to determine the optimum number of elevator cars based on traffic forecast data generated based on statistical call allocation data.

In one embodiment, alternatively or in addition, the means for commanding are configured to take into account a transition period of an elevator car to or from the at least one elevator car storage when commanding the at least one elevator car into the at least one elevator car storage or back to service from the at least one elevator car storage.

According to a third aspect of the invention, there is provided a computer program comprising program code, which when executed by at least one processing unit, causes the at least one processing unit to perform the method of the first aspect.

In one embodiment, the computer program is embodied on a computer readable medium.

According to a fourth aspect of the invention, there is provided an elevator system comprising a pair of elevator shafts, wherein the elevator shafts are connected to each other and wherein elevator cars are configured to move upwards in a first elevator shaft and downwards in a second elevator shaft, an apparatus of the second aspect, and at least one elevator car storage, wherein elevator cars in the at least one elevator car storage act as standby elevator cars for the multi-car elevator shaft system.

In one embodiment, the at least one elevator car storage is connected to both elevator shafts to enable addition and removal of an elevator car to/from both elevator shafts.

In one embodiment, the elevator system comprises multiple elevator car storages connected to the first and/or second elevator shaft.

In one embodiment, the elevator system further comprises a second pair of elevator shafts, wherein the at least elevator car storage is configured to enable addition and removal of an elevator car to/from both pairs of elevator shafts.

The means disclosed above may be implemented using at least one processor or at least one processor and at least one memory connected to the at least one processor, the memory storing program instructions to be executed by the at least one processor.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Figure 1:
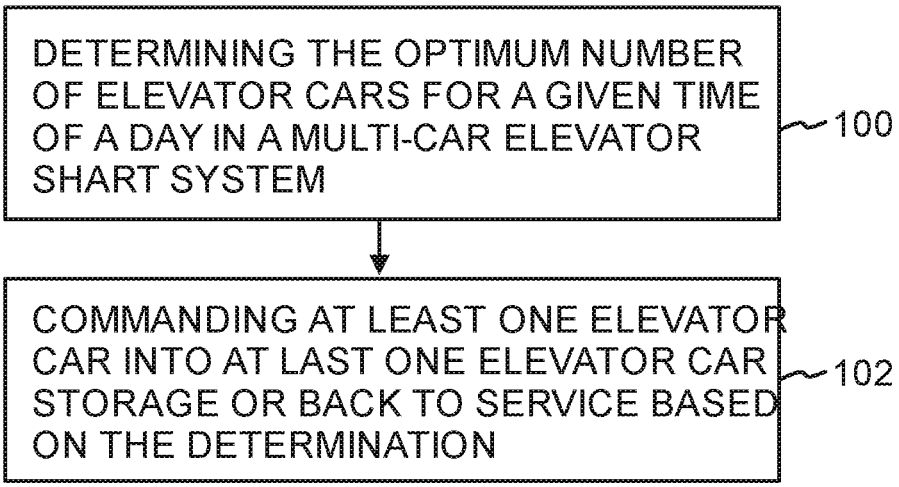
FIG. 1 is a flow diagram illustrating a method for managing elevator cars in a multi-car elevator shaft system according to one embodiment.

FIG. 1 is a flow diagram illustrating a method for managing elevator cars in a multi-car elevator shaft system according to one embodiment. In the multi-car elevator shaft system, two or more cars move in two elevator shafts independently, always in the same direction in one shaft, and change the shaft, for example, on the bottom and the top floor. In other words, the cars move upwards in one shaft and downwards in another shaft, and never move towards each other. A control system of the multi-car elevator shaft system assigns and dispatches elevator cars to serve landing or destination calls.

The multi-car elevator shaft system comprises at least one elevator car storage. Elevator cars in the at least one elevator car storage act as standby elevator cars for the multi-car elevator shaft system.

At 100 an elevator control entity of the multi-car elevator shaft system determines the optimum number of elevator cars for a given time of a day. If the current number of elevator cars is below the optimum, the elevator control entity may command at least one elevator car from at least one elevator car storage back to service, as illustrated at 102. Similarly, if the current number of elevator cars is above the optimum, the elevator control entity may command at least one elevator car back to the at least one elevator car storage.

The determination of the optimum number of elevator cars may be based on the current call allocation situation. For example, if the current amount of elevators cars deviates from the optimum amount of cars for a predetermined period of time, the elevator control entity may either command at least one elevator car into at least one elevator car storage or back to service from the at least one elevator car storage depending on the situation.

The determination of the optimum number of elevator cars may also be based on the based on traffic forecast data generated based on statistical call allocation data. For example, call allocation statistics may be gathered during a long period of time, for example, weeks or months or even years. Based on the statistics, it may become apparent that some time periods, for example, within a specific weekday may have higher call intensities than others. These statistics can then be made use of when forecasting future calls in the multi-car elevator shaft system. If the traffic forecast data forecasts that the call intensity will become higher, the elevator control entity may command at least one elevator car back to service from the at least one elevator car storage.

Further, in one embodiment, the elevator control entity may take into account a transition period of an elevator car to or from the at least one elevator car storage when commanding at least one elevator car into the at least one elevator car storage or back to service from the at least one elevator car storage. For example, if it takes three minutes for an elevator car to be brought back to service, and the elevator control entity knows from the forecast data that high service intensity period starts in 10 minutes, the elevator control entity commands at least one elevator car back to service from the at least one elevator car storage so that they are in use when 10 minutes have elapsed.

By providing at least one elevator car storage it is possible to vary and optimize the number of elevator cars in service in the multi-car elevator shaft system, for example, based on statistical history data and/or forecast data. Further, by keeping the amount of elevator cars in service optimum, the amount of energy used by the elevator system is optimized.

Figure 2A:
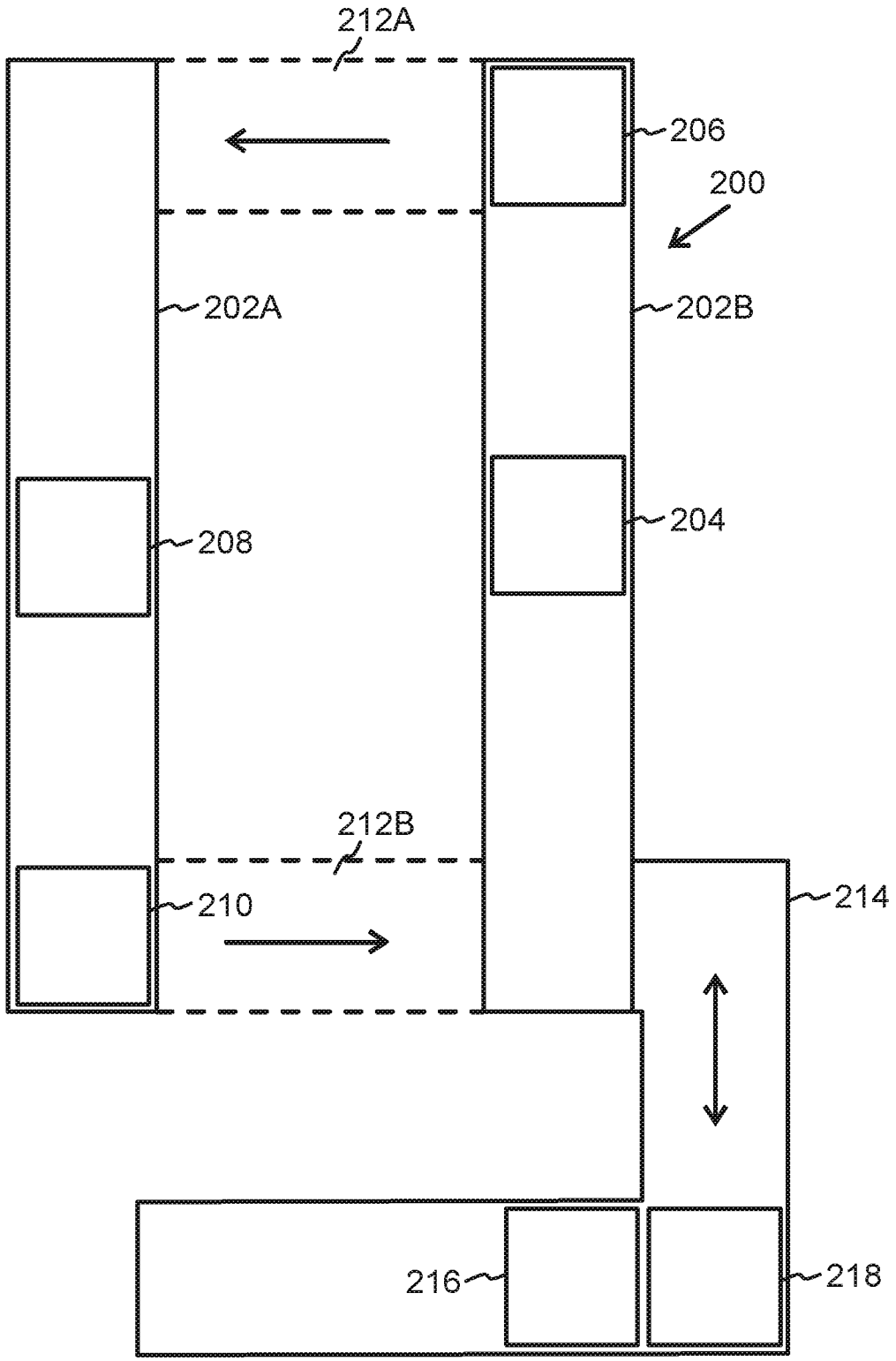
FIG. 2A is system diagram illustrating a multi-car elevator shaft system according to one embodiment.

FIG. 2A is system diagram illustrating a multi-car elevator shaft system 200 according to one embodiment. The multi-car elevator shaft system 200 comprises two elevator shafts 202A, 202B connected to each other via connecting passageways 212A, 212B. Two or more cars 204, 206, 208, 210 move in the elevator shafts 202A, 202B independently, always in the same direction in one shaft, and change the shaft, for example, on the bottom and the top floor. In other words, the cars 204, 206, 208, 210 move upwards in one shaft and downwards in another shaft, and never move towards each other. An elevator control entity of the multi-car elevator shaft system assigns and dispatches elevator cars to serve landing or destination calls.

The multi-car elevator shaft system comprises 200 an elevator car storage 214. Elevator cars 216, 218 in the elevator car storage 214 act as standby elevator cars for the multi-car elevator shaft system 200. One or more elevator cars from the elevator car storage 214 can be taken back to service if the traffic situation of the multi-car elevator shaft system 200 calls for it. Similarly, one or more elevator cars may be put back to the elevator car storage 214 if the traffic situation of the multi-car elevator shaft system 200 allows it.

Figure 2B:
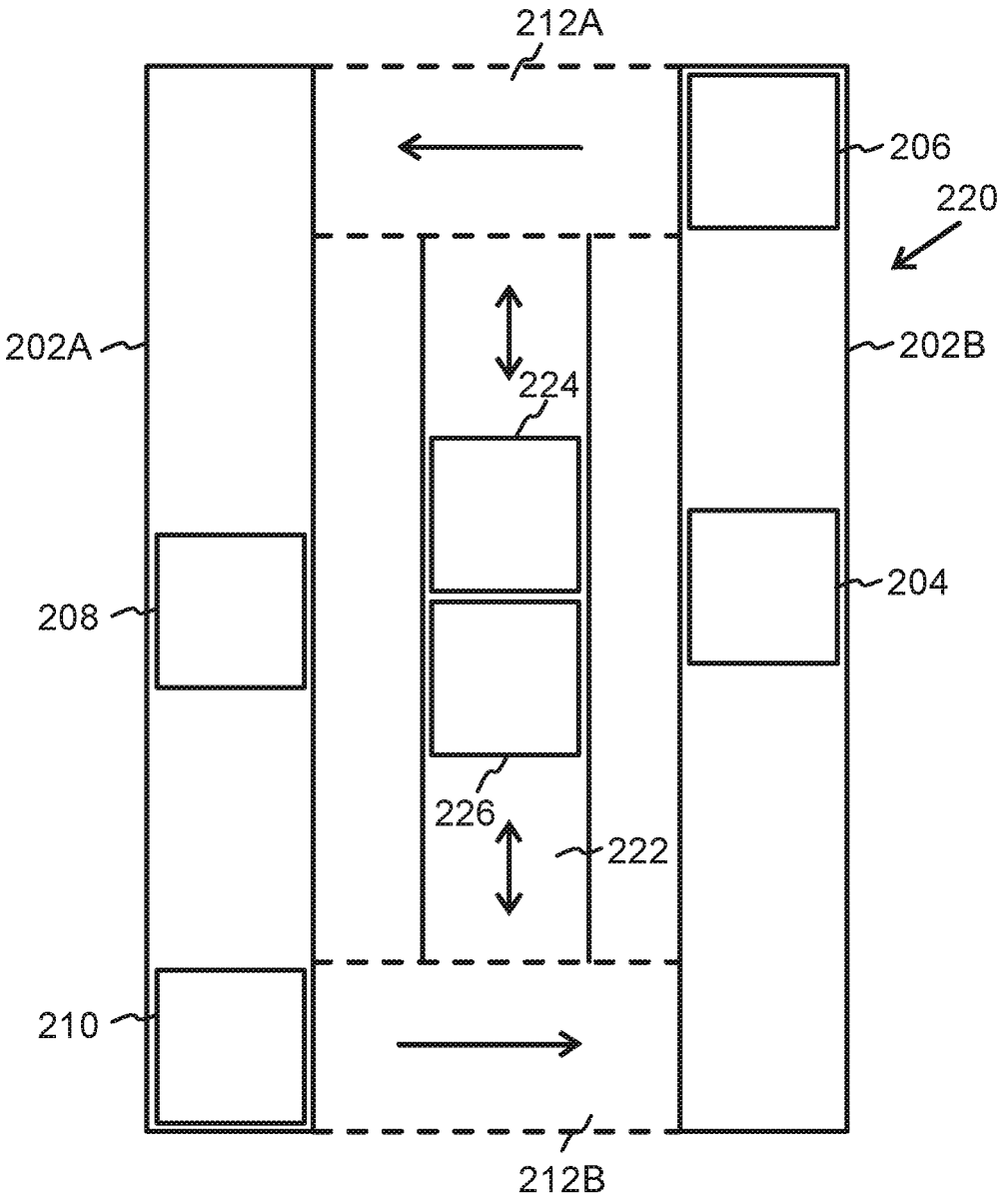
FIG. 2B is system diagram illustrating a multi-car elevator shaft system according to another embodiment.

FIG. 2B is system diagram illustrating a multi-car elevator shaft system 220 according to another embodiment. The multi-car elevator shaft system 220 comprises two elevator shafts 202A, 202B connected to each other via connecting passageways 212A, 212B. Two or more cars 204, 206, 208, 210 move in the elevator shafts 202A, 202B independently, always in the same direction in one shaft, and change the shaft, for example, on the bottom and the top floor. In other words, the cars 204, 206, 208, 210 move upwards in one shaft and downwards in another shaft, and never move towards each other. An elevator control entity of the multi-car elevator shaft system assigns and dispatches elevator cars to serve landing or destination calls.

The multi-car elevator shaft system 220 comprises an elevator car storage 222. Elevator cars 224, 226 in the elevator car storage 222 act as standby elevator cars for the multi-car elevator shaft system 220. One or more elevator cars from the elevator car storage 224 can be taken back to service if the traffic situation of the multi-car elevator shaft system 200 calls for it. Similarly, one or more elevator cars may be put back to the elevator car storage 222 if the traffic situation of the multi-car elevator shaft system 220 allows it. In this embodiment, the elevator car storage 222 is connected from both of its ends to the connecting passageways 212A, 212B. This allows adding and/or removing elevator cars to/from both ends of the elevator system 220.

Figure 2C:
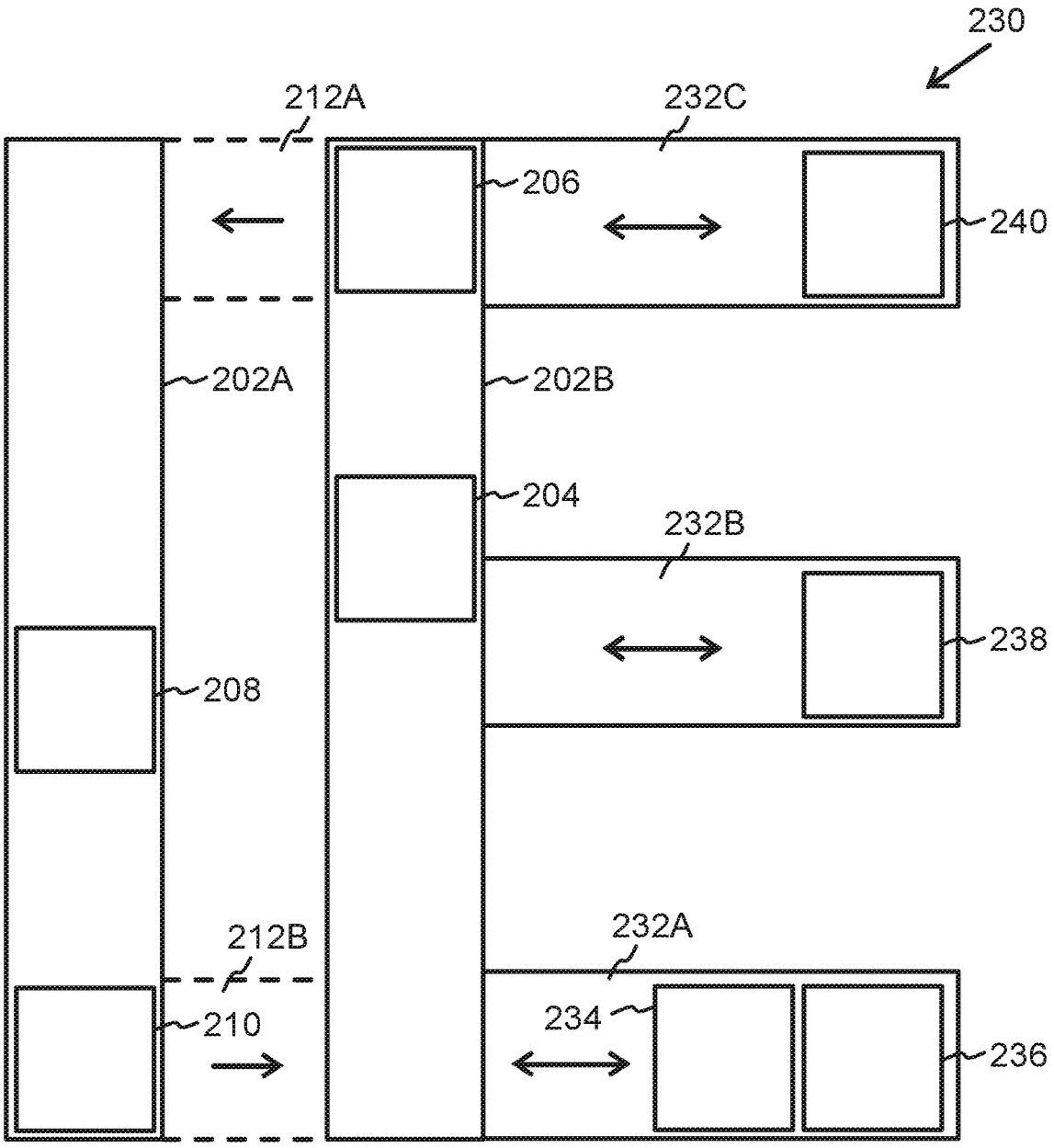
FIG. 2C is system diagram illustrating a multi-car elevator shaft system according to another embodiment.

FIG. 2C is system diagram illustrating a multi-car elevator shaft system 230 according to another embodiment. The multi-car elevator shaft system 230 comprises two elevator shafts 202A, 202B connected to each other via connecting passageways 212A, 212B. Two or more cars 204, 206, 208, 210 move in the elevator shafts 202A, 202B independently, always in the same direction in one shaft, and change the shaft, for example, on the bottom and the top floor. In other words, the cars 204, 206, 208, 210 move upwards in one shaft and downwards in another shaft, and never move towards each other. An elevator control entity of the multi-car elevator shaft system assigns and dispatches elevator cars to serve landing or destination calls.

The multi-car elevator shaft system 230 comprises a separate elevator car storage 232A, 232B, 232C for each floor of the elevator shaft 202B. Elevator cars 234, 236, 238, 240 in the elevator car storages 232A, 232B, 232C act as standby elevator cars for the multicar elevator shaft system 230. One or more elevator cars from the elevator car storages 232A, 232B, 232C can be taken back to service if the traffic situation of the multi-car elevator shaft system 230 calls for it. Similarly, one or more elevator cars may be put back to any of the elevator car storages 232A, 232B, 232C if the traffic situation of the multi-car elevator shaft system 230 allows it.

Figure 2D:
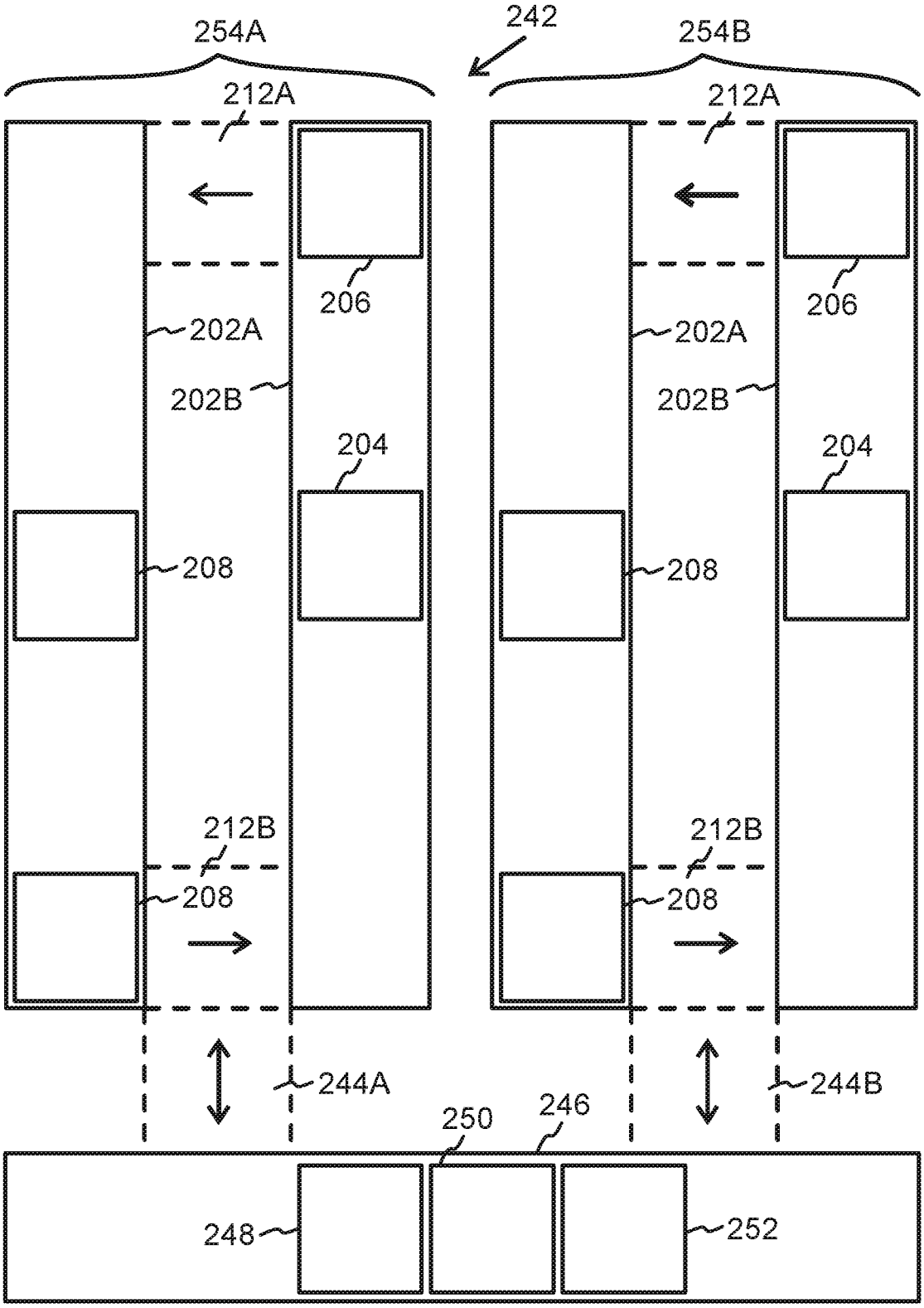
FIG. 2D is system diagram illustrating a multi-car elevator shaft system according to another embodiment.

FIG. 2D is system diagram illustrating a multi-car elevator shaft system 242 according to another embodiment. The multi-car elevator shaft system 242 comprises two pairs 254A, 254B of elevator shafts 202A, 202B. The elevator shafts 202A, 202B are connected to each other via connecting passageways 212A, 212B. Two or more cars 204, 206, 208, 210 move in the elevator shafts 202A, 202B independently, always in the same direction in one shaft, and change the shaft, for example, on the bottom and the top floor. In other words, the cars 204, 206, 208, 210 move upwards in one shaft and downwards in another shaft, and never move towards each other. An elevator control entity of the multi-car elevator shaft system assigns and dispatches elevator cars in the pairs 254A, 254B of elevator shafts 202A, 202B to serve landing or destination calls.

The multi-car elevator shaft system 242 comprises an elevator car storage 246 that serves both pairs 254A, 254B of elevator shafts. Elevator cars 248, 250, 252 in the elevator car storage 246 act as standby elevator cars for the multi-car elevator shaft system 242. One or more elevator cars from the elevator car storage 246 can be taken back to service via connecting passageways 244A, 244B if the traffic situation of the multi-car elevator shaft system 242 calls for it. Similarly, one or more elevator cars may be put back to the elevator car storage 246 if the traffic situation of the multi-car elevator shaft system 242 allows it.

Although FIGS. 2A, 2B, 2C and 2D illustrate specific embodiments having a certain amount of elevator cars, a certain amount of elevator shafts and specific amounts and locations for elevator car storages, also other arrangements and variations are possible.

Figure 3:
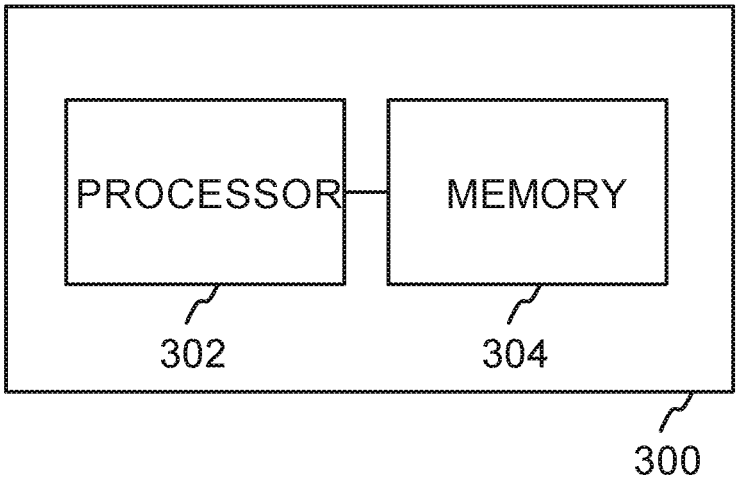
FIG. 3 is a block diagram of an apparatus for managing elevator cars in a multi-car elevator shaft system according to one embodiment.

FIG. 3 is a block diagram illustrating an apparatus 300 for managing elevator cars in a multi-car elevator shaft system in accordance with one embodiment. The apparatus 300 comprises at least one processor 302 connected to at least one memory 304. The at least one memory 304 may comprise at least one computer program which, when executed by the processor 302 or processors, causes the apparatus 300 to perform the programmed functionality. The apparatus 300 may be configured to determine the optimum number of elevator cars for a given time of a day in the multi-car elevator shaft system, and command at least one elevator car into at least one elevator car storage or back to service from the at least one elevator car storage based on the determination, wherein elevator cars in the at least one elevator car storage act as standby elevator cars for the multi-car elevator shaft system.

The apparatus 300 may also comprise input/output ports and/or one or more physical connectors, which can be an Ethernet port, a Universal Serial Bus (USB) port, IEEE 1394 (FireWire) port, and/or RS-232 port. The illustrated components are not required or all-inclusive, as any components can deleted and other components can be added.

The apparatus 300 may be an elevator control entity configured to implement only the above disclosed operating features relating to FIG. 1, or it may be part of a larger elevator control entity.

The processor 302 and the memory 304 may also constitute means for determining the optimum number of elevator cars for a given time of day in the multi-car elevator shaft system, and means for commanding at least one elevator car into at least one elevator car storage or back to service from the at least one elevator car storage based on the determination, wherein elevator cars in the at least one elevator car storage act as standby elevator cars for the multi-car elevator shaft system.

The exemplary embodiments of the invention can be included within any suitable device, for example, including, servers, workstations, personal computers, laptop computers, capable of performing the processes of the exemplary embodiments. The exemplary embodiments may also store information relating to various processes described herein.

Example embodiments may be implemented in software, hardware, application logic or a combination of software, hardware and application logic. The example embodiments can store information relating to various methods described herein. This information can be stored in one or more memories, such as a hard disk, optical disk, magneto-optical disk, RAM, and the like. One or more databases can store the information used to implement the example embodiments. The databases can be organized using data structures (e.g., records, tables, arrays, fields, graphs, trees, lists, and the like) included in one or more memories or storage devices listed herein. The methods described with respect to the example embodiments can include appropriate data structures for storing data collected and/or generated by the methods of the devices and subsystems of the example embodiments in one or more databases.

All or a portion of the example embodiments can be conveniently implemented using one or more general purpose processors, microprocessors, digital signal processors, micro-controllers, and the like, programmed according to the teachings of the example embodiments, as will be appreciated by those skilled in the computer and/or software art(s). Appropriate software can be readily prepared by programmers of ordinary skill based on the teachings of the example embodiments, as will be appreciated by those skilled in the software art. In addition, the example embodiments can be implemented by the preparation of application-specific integrated circuits or by interconnecting an appropriate network of conventional component circuits, as will be appreciated by those skilled in the electrical art(s). Thus, the examples are not limited to any specific combination of hardware and/or software. Stored on any one or on a combination of computer readable media, the examples can include software for controlling the components of the example embodiments, for driving the components of the example embodiments, for enabling the components of the example embodiments to interact with a human user, and the like. Such computer readable media further can include a computer program for performing all or a portion (if processing is distributed) of the processing performed in implementing the example embodiments. Computer code devices of the examples may include any suitable interpretable or executable code mechanism, including but not limited to scripts, interpretable programs, dynamic link libraries (DLLs), Java classes and applets, complete executable programs, and the like.

As stated above, the components of the example embodiments may include computer readable medium or memories for holding instructions programmed according to the teachings and for holding data structures, tables, records, and/or other data described herein. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer. A computer-readable medium may include a computer-readable storage medium that may be any media or means that can contain or store the instructions for use by or in connection with an instruction execution system, apparatus, or device, such as a computer. A computer readable medium can include any suitable medium that participates in providing instructions to a processor for execution. Such a medium can take many forms, including but not limited to, non-volatile media, volatile media, transmission media, and the like.

While there have been shown and described and pointed out fundamental novel features as applied to preferred embodiments thereof, it will be understood that various omissions and substitutions and changes in the form and details of the devices and methods described may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiments may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. A method for managing elevator cars in a multi-car elevator shaft system, the method comprising:

determining, by an elevator controller, the optimum number of elevator cars for a given time of a day in the multi-car elevator shaft system; and commanding, by the elevator controller, at least one elevator car into at least one elevator car storage or back to service from the at least one elevator car storage based on the determination, wherein elevator cars in the at least one elevator car storage act as standby elevator cars for the multi-car elevator shaft system.

2. A method of claim 1, further comprising:

determining, by the elevator controller, the optimum number of elevator cars based on the current call allocation situation.

3. A method of claim 1, further comprising:

determining, by the elevator controller, the optimum number of elevator cars based on traffic forecast data generated based on statistical call allocation data.

4. A method of claim 1, further comprising:

taking into account, by the elevator controller, a transition period of an elevator car to or from the at least one elevator car storage when commanding the at least one elevator car into the at least one elevator car storage or back to service from the at least one elevator car storage.

5. An apparatus for managing elevator cars in a multi-car elevator shaft system, the apparatus comprising a processor configured to:

determine the optimum number of elevator cars for a given time of day in the multi-car elevator shaft system; and command at least one elevator car into at least one elevator car storage or back to service from the at least one elevator car storage based on the determination, wherein elevator cars in the at least one elevator car storage act as standby elevator cars for the multi-car elevator shaft system.

6. An apparatus of claim 5, wherein the processor is configured to determine the optimum number of elevator cars based on the current call allocation situation.

7. An apparatus of claim 5, wherein the processor is configured to determine the optimum number of elevator cars based on traffic forecast data generated based on statistical call allocation data.

8. An apparatus of claim 5, wherein the processor is configured to take into account a transition period of an elevator car to or from the at least one elevator car storage when commanding the at least one elevator car into the at least one elevator car storage or back to service from the at least one elevator car storage.

9. A non-transitory computer readable medium storing a computer program comprising program code, which when executed by at least one processor unit, causes the at least one processor to perform the method of claim 1.

10. An elevator system comprising:

a pair of elevator shafts, wherein the elevator shafts are connected to each other and wherein elevator cars are configured to move upwards in a first elevator shaft and downwards in a second elevator shaft;

an apparatus of claim 5; and at least one elevator car storage, wherein elevator cars in the at least one elevator car storage act as standby elevator cars for the multi-car elevator shaft system.

11. An elevator system of claim 10, wherein the at least one elevator car storage is connected to both elevator shafts to enable addition and removal of an elevator car to/from both elevator shafts.

12. An elevator system of claim 10, wherein the elevator system comprises multiple elevator car storages connected to the first and/or second elevator shaft.

13. An elevator system of claim 10, further comprising:

a second pair of elevator shafts, wherein the at least elevator car storage is configured to enable addition and removal of an elevator car to/from both pairs of elevator shafts.

14. A method of claim 2, further comprising:

determining, by the elevator controller, the optimum number of elevator cars based on traffic forecast data generated based on statistical call allocation data.

15. A method of claim 2, further comprising:

taking into account, by the elevator controller, a transition period of an elevator car to or from the at least one elevator car storage when commanding the at least one elevator car into the at least one elevator car storage or back to service from the at least one elevator car storage.

16. A method of claim 3, further comprising:

taking into account, by the elevator controller, a transition period of an elevator car to or from the at least one elevator car storage when commanding the at least one elevator car into the at least one elevator car storage or back to service from the at least one elevator car storage.

17. An apparatus of claim 6, wherein the processor is configured to determine the optimum number of elevator cars based on traffic forecast data generated based on statistical call allocation data.

18. An apparatus of claim 6, wherein the processor is configured to take into account a transition period of an elevator car to or from the at least one elevator car storage when commanding the at least one elevator car into the at least one elevator car storage or back to service from the at least one elevator car storage.

19. An apparatus of claim 7, wherein the processor is configured to take into account a transition period of an elevator car to or from the at least one elevator car storage when commanding the at least one elevator car into the at least one elevator car storage or back to service from the at least one elevator car storage.

* * * * *